United States Patent [19]

Strumbos

[11] Patent Number: 4,972,812

[45] Date of Patent: Nov. 27, 1990

[54] SPARK PLUG THERMAL CONTROL

[76] Inventor: William P. Strumbos, 85 Middleville Rd., Northport, N.Y. 11768

[21] Appl. No.: 400,804

[22] Filed: Aug. 30, 1989

[51] Int. Cl.[5] ..... H01T 13/16; F01P 1/10

[52] U.S. Cl. ..... 123/169 C; 313/11.5; 313/136; 313/143

[58] Field of Search ..... 123/169 R, 169 C, 169 CL, 123/69 EL, 169 V, 41.31; 165/104.33; 313/118, 120, 141, 143, 11.5, 34, 136

[56] References Cited

U.S. PATENT DOCUMENTS

| | | | |
|---|---|---|---|
| 4,325,332 | 4/1982 | Hukill | 313/120 X |
| 4,491,101 | 1/1985 | Strumbos | 123/169 C |
| 4,513,220 | 4/1985 | Togashi | 313/120 |
| 4,736,718 | 4/1988 | Linder | 313/143 X |
| 4,810,929 | 3/1989 | Strumbos | 123/169 CL X |

*Primary Examiner*—Willis R. Wolfe

[57] ABSTRACT

A spark plug with a heat pipe in the centerbore of the insulator thereof for controlling the operating temperature of the spark plug firing end automatically. A vaporizable medium in the heat pipe vaporizes when the load on the engine causes the temperature of the engine cylinder in which the spark plug is installed to rise into a temperature range in which damage to its firing end can occur. In that temperature range, the change of state of the vaporizable medium extracts heat from the firing end to prevent its overheating. The vapor pressure of the vaporied medium moves the vapor to a condensation zone where it condenses and releases its heat by a change of state. The condensate is returned to the vaporization zone by capillary means and the cycle is repeated as long as the firing end is in the overheating range of the spark plug. When engine temperatures drop, the heat pipe becomes non-conducting but the design of the spark plug firing end is such that it runs hot to burn off fouling deposits that can settle thereon in the engine no-load phase of operation. In this invention, the capillary grooves of the heat pipe are incised directly into the insulator centerbore defining the side walls of the heat pipe such that heat transfer from the condensation zone of the heat pipe to the heat sink provided by the engine is optimized.

2 Claims, 1 Drawing Sheet

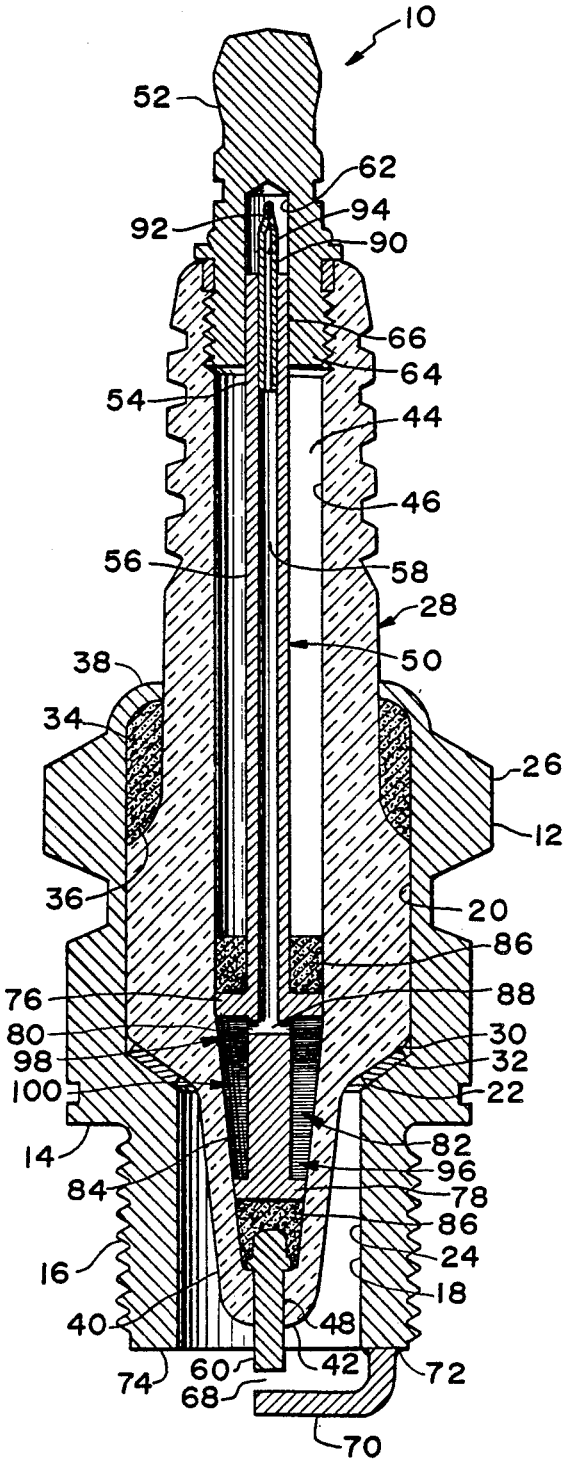
10
52
62
94
92
90
66
64
54
44
46
56
58
28
50
38
34
26
12
36
20
86
76
88
80
30
98
32
100
22
14
82
96
84
78
86
24
16
18
40
48
74
60
42
72
68
70

SPARK PLUG THERMAL CONTROL

FIELD OF THE INVENTION

This invention relates to spark plugs for internal combustion engines and, more particularly, to spark plugs in which the walls of the insulator itself of the spark plug define a heat pipe for automatically varying the operative heat range of the spark plug.

BACKGROUND OF THE INVENTION

Spark plugs are conventionally furnished in various heat ranges, the heat range being a measure of the thermal capacity of the spark plug. Because different engines develop different amounts of heat in their combustion chambers during their various phases of operation, they are fitted with spark plugs whose heat ranges are most appropriate for the normal operating conditions of the engine. In operation, the electrodes and insulator of the spark plug adjust to a mean temperature corresponding to the engine load. The insulator nose should be at an operating temperature of between 450° C. (842° F.) and 850° C. (1562° F.) for proper operation. Temperatures above 450° C., the self-cleaning temperature are desirable because at those temperatures the deposits on the insulator in the form of soot, carbon residue, and other compounds are burnt off or undergo chemical change. At idle or part load such as during city driving, at intersections, or on downgrades or the like, the insulator nose temperature often drops below 150° C. (302° F.). If the amount of engine lubricating oil entering the combustion chamber due to worn piston rings, intake valves, etc.; if the fuel-air mixture is not too rich; and if this low temperature is not maintained for too long a time; the spark plug will usually still function properly. A temperature of 850° C. at the insulator should not exceeded, because above 900°C. (1652° F.) auto-ignition can occur, and at very high temperatures the electrodes are also subjected to increased attack or destruction by sulphur and other aggressive compounds resulting from the combustion process.

Conventional spark plug characteristics can thus be defined as follows:

The lower the heat range index of a spark plug, the higher its resistance to auto-ignition, but the lower its resistance to fouling.

The higher the heat range index of the spark plug, the lower its resistance to auto-ignition, but the higher its resistance to fouling.

Because of the wide range of operating conditions an engine can encounter, the selection of the proper heat range for a spark plug for a specific engine necessarily is a compromise. Thus, there is always the possibility that the engine will be operated under conditions that are wrong for the heat range of the spark plug installed therein. This possibility can lead to poor performance and engine damage with consequent owner dissatisfaction. To overcome these and other serious disadvantages of prior art spark plugs, it is thus a principal object of this invention to provide a multiple heat range spark plug whose operating temperature is varied automatically such that it operates at an optimum temperature during all phases of engine operation. It is a concurrent object of this invention to provide a heat pipe in the spark plug to maintain it automatically at an optimum operating temperature, with the centerbore of the spark plug insulator itself forming the walls and incorporating the capillary means of the heat pipe such that its most effective heat transfer characteristics are obtained. A further object is to provide a spark plug whose insulator nose operates at a self-cleaning temperature at all times to thereby reduce the danger of combustion misses and misfiring which cause sharp increases in the emission of hydrocarbons, to thus yield advantages with respect to exhaust-gas values in low load ranges while at the same time improving fuel economy.

DESCRIPTION OF THE PRIOR ART

In the prior art, there are disclosures by J. E. Genn and A. A. Kasarjian in U.S. Pat. Nos. 1,315,298 and 2,096,250 respectively of dynamic convective heat transfer means in the center conductor of a spark plug and D. Scherenberg it al. in U.K. patent No. GB2025525B discloses a construction in which a heat pipe is provided in the center electrode of an ignition/-pre-combustion chamber device for the dissipation of heat from the center electrode lower end to cooling fins on the distal end of the electrode. It is seen, however, that the heat transfer means of these prior art disclosures are contained in the center conductor or the electrode of the device and they are devoid of any teaching of the walls of the centerbore of the insulator itself defining the walls of the heat pipe chamber. There is a teaching of the walls of the insulator centerbore forming the walls of the heat pipe in U.S. Pat. No. 4,810,929 granted to W. P. Strumbos, the inventor also in the present invention. That previous W. P. Strumbos patent, which is incorporated herein by reference, does not live the capillary grooves of the heat pipe incised in the walls thereof but requires the provision of separate wicking means applied on the insulator centerbore walls to serve the condensate return function. The present invention integrates the required wicking (capillary) means into the walls of the insulator itself to enable the spark plug to be produced using conventional spark plug manufacturing equipment and techniques such that the cost differential between the improved spark plug of this invention and conventional spark plugs is favorably reduced.

SUMMARY OF THE INVENTION

In this invention, the heat range of a spark plug is varied automatically in response to engine operating conditions by a predetermined evaporative/condensate heat transfer of a working fluid in a heat pipe defined by the spark plug insulator centerbore.

The spark plug of this invention has a conventional shell which mounts the ground electrode, an insulator containing the center conductor assembly, the heat pipe, and a terminal for connection to the spark ignition system of the engine in which the spark plug operates. The insulator has an elongated firing end similar to that of an insulator of a conventional spark plug with the lowest IMEP (Indicated Mean Effective Pressure) rating; i.e., the hottest heat range or rating in the required thread size and reach for the engine in which it is to be installed. Conventionally, spark plugs are produced such that the required heat range "steps" are provided within a "family" of spark plugs, the "family" being those plugs with the required span of heat ranges with the safe mounting (thread diameter and reach) dimensions. Inasmuch as the heat range of the spark plug of the present invention is varied automatically to accommodate the engine operating conditions, a "family" will contain only one specific spark plug. The heat pipe is provided with a working fluid which can be any known suitable element or compound that vaporizes at about the design temperature of approximately 850° C. (1562° F.). An amount of working fluid normally in excess of that required to completely wet the capillary grooves is provided and an inert non-condensable gas can be introduced into the heat pipe as is well known to vary its operating characteristics.

BRIEF DESCRIPTION OF THE FIGURE

The above-mentioned objects and advantages of the present invention will be understood more clearly when considered in conjunction with the accompanying drawing, in which:

The FIGURE is an elevational cross-sectioned view of the present invention.

DESCRIPTION OF THE PREFERRED EMBODIMENTS

The novel features of the present invention are set forth in the appended claims. The invention itself, however, will be understood most readily from the following description when considered in connection with the accompanying drawing in which the single FIGURE represents a front elevational view in longitudinal section of the spark plug 10 of the invention. Spark plug 10 has a conventional annular metallic shell 12 which has an annular external seat 14 below which is a length of reduced diameter which is externally threaded 16 for installing the spark plug into a threaded bore in the cylinder of an engine (not shown) with seat 14 in sealing contact on an annular mounting boss on the cylinder head. When so installed, the shell forms an electrical ground. Shell 12 is provided with a bore 18 therethrough with a first section 20 having a shoulder 22 and a second section 24 of reduced diameter. A wrench-engageable head 26 is provided on the shell for screwing the spark plug into the cylinder head.

Installed in the bore 18 of the shell in a sealed relationship therewith is an elongated electrical insulator 28, which is preferably made of a sintered alumina ceramic. Insulator 28 has a lower annular shoulder 30 which seats on an annular soft metal gasket 32 on shoulder 22 of the shell in a sealed relationship therewith. A sillment seal 34 interposed between insulator upper annular shoulder 36 and shell upper rim 38 when the rim is turned down to lock the insulator in the shell serves as an upper pressure-and gas-tight seal as is well known in the art. The lower length 40 of the insulator is tapered to its firing end 42 which is in a spaced relationship with the lower bore 24 of the shell.

The insulator 28 has a centerbore 44 having a section 46 of a first diameter and a lower section which tapers to a section 48 of a further reduced diameter. Received in centerbore 44 is a center conductor assembly 50 comprising an electrical terminal 52, a centerwire 54 having a tubular upper length 56 with a centerbore 58 and a solid lower end, and a center electrode 60. The terminal 52 is conventionally configured for connection with the ignition system of the engine in which the spark plug is installed. A centerbore 62 in the insulator end 64 of the terminal receives the upper end 66 of the centerwire 54 and the center electrode 60 is received in the lower bore 48 of the insulator firing end and protrudes therefrom in a spaced relationship to form a sparking gap 68 with a ground electrode 70 whose distal end 72 is welded to the lower rim 74 of the shell. The centerwire 54 is provided with an upper 76 and a lower 78 circular transverse flange which extend outwardly into contact with section 80 of the wall of the insulator centerbore 44. Flanges 76 and 78 define the upper and lower end walls respectively and centerbore wall section 80 the side wall to thus form the chamber of the spark plug heat pipe 82. It will be appreciated that the end walls of the heat pipe can be toroidal mexbers fastened on centerwire 54 rather than the integral circular flanges 76 and 78 shown and they can be made of a material whose coefficient of thermal expansion favorably matches that of the insulator centerbore. In this invention, the capillary grooves 84 of the heat pipe are incised directly into the wall 80 of the insulator centerbore such that the thermal transfer characteristics of the construction are optimized. A helical arrangement of grooves 84 are shown, but it is well known that other arrangements of capillary grooves can be employed. The lower end of the heat pipe promimate the spark plug firing end forms the vaporization zone 96, the end distal therefrom forms the condensation zone 98, and the section therebetween the adiabatic zone 100 of the heat pipe. The center electrode 60 and the lower end wall 78 of the heat pipe and the lower portion of the tubular centerwire 54 and the upper end wall 76 of the heat pipe are embedded in a suitable known fused electrically conductive ceramic or glass seal 86 which forms a pressure and gastight seal for the center conductor assembly and ensures the hermetic integrity of the heat pipe. The centerbore 58 of the tubular section of the centerwire 54 is the means used for filling the heat pipe with a suitable vaporizable heat transfer medium. Depending on the design temperature point chosen, the heat transfer *edium can be any suitable vaporizable substance which can be sodium or preferably potassium. To vary the thermal characteristics of the heat pipe an inert non-condensible gas can also be introduced into the heat pipe in a known manner. The lower end of the centerwire centerbore 58 is provided with a transverse passage 88 opening in the heat pipe chamber and a soft metal heat pipe filling tube 90 is received in the upper end of the centerwire centerbore with the upper end 92 extending therefrom. The bore 94 of the filling tube can be of a size that fits a suitable heat pipe charging means (not shown).

In the spark plug of this invention, it is preferred to fill the heat pipe after the center conductor assembly is installed in the insulator centerbore and seals 86 are fused to fix the components in place and after the insulator is installed in the shell and is sealed therein by heating and turning down shell upper rim 38. (It will be recognized that the spark plug embodied in this invention, except for the heat pipe, is designed and has the components of a conventional spark plug with a very low IMEP rating. It can, therefore, be manufactured using essentially standard spark plug production facilities, equipment, and assembly procedures.) To charge the heat pipe, the heat pipe filling or charging means employed injects a charge of the required heat pipe constituents into the filling tube where it passes through the centerwire centerbore 58 and into the heat pipe 82. Following this step of charging the heat pipe, the upper end of the filling tube is pinched or crimped securely closed and can be soldered as is the usual heat pipe practice. Centerbore 58 can be of a suitable size to serve as at least a partial reservoir for the inert, non-condensible gas, if such is used in the heat pipe.

In operation, except for the thermal control provided by the heat pipe, spark plug 10 performs in a conventional manner to ignite the fuel/air mixture drawn into the engine cylinder. When operating below some specific design temperature in which fouling can occur, heat pipe 82 is thermally non-conducting such that the spark plug behaves as a conventional "hot" plug with heat from the firing end being required to pass up the length of the relatively long insulator nose before it passes through gasket 32 and the shell into the heat sink provided by the engine. Thus, heat is transferred slowly from the firing end such that the spark plug operates at a temperature which is high enough to burn off fouling deposits even during prolonged periods of idling or low-speed operation. This can be considered to be the "hot" range of the spark plug of the invention.

When the operating temperature in the engine cylinder rises above the design point, heat from the firing ends of the center electrode and the insulator supplies heat of vaporization to the heat pipe medium in the vaporization zone of the heat pipe, vaporizing the medium such that its change of state extracts heat from the firing end of the spark plug. This vaporization in the vaporization zone increases the vapor pressure therein, causing vapor to flow to the lower pressure adiabatic zone and thence to the condensation zone. There the vapor is cooled and condenses on the insulator bore to give off its heat of liquefaction. The condensed medium returns to the vaporization zone by the capillary pumping action of the capillary means such that a circulation that transfers heat from the firing end to the condensation zone is thereby established. As is known, the temperature gradient is very small over the entire length of the heat pipe and a large amount of heat is transferred. Because of the high thermal conductivity of the heat pipe (600 times greater than pure copper), heat is transferred rapidly from the firing end such that the temperatures of the spark plug remain relatively low to thereby avoid self-ignition, pre-ignition, and thermal erosion problems. This can be considered to be the "cold" range of the spark plug of the invention.

Should operating conditions cause engine cylinder temperatures to drop such that the firing end temperatures fall below the design point, vaporization of the heat pipe working medium will cease and the heat pipe will automatically stop conducting heat. With the heat pipe becoming thermally non-conducting, the spark plug will revert to its "hot" range.

To avoid fouling which occurs at spark plug temperatures below about 450° C. (842° F.), the heat pipe should be designed to become operative above about that temperature, preferably somewhere in the range between about 482° C. (900° F.) and about 850° C. (1562° F.), and the working medium and other design parameters should he chosen accordingly. It will be recognized that the use of different fuels, and additives, and other changes in the constituents of the fuels can vary the temperatures at which the deposits of combustion products occur. Thus, the preferred design temperature range can vary from that listed and the parameters of the design should be changed to suit the changed conditions.

What is claimed is:

1. An internal combustion engine spark plug embodying a heat pipe for automatically varying its operative heat range according to changes in the combustion temperatures within the engine, said spark plug having a terminal end and an inner firing end and comprising an annular metal shell mounting a ground electrode and having external threads for installing said spark plug for operation in an engine, an electrical insulator received in the centerbore of said shell with the insulator inner firing end nose portion being tapered and in a radially spaced relationship with said centerbore of said shell, a center conductor assembly received in a centerbore in said insulator, said insulator centerbore promimate said firing end defining the side walls of said heat pipe, means defining the end walls of said heat pipe, said heat pipe being hermetically sealed and containing a vaporizable heat pipe medium and having a vaporization zone and a condensation zone with an adiabatic zone therebetween, capillary means extending from said vaporization zone to said condensation zone, said center conductor assembly having at least said terminal, a centerwire with means for filling said heat pipe, and a center electrode having a firing end positioned with respect to said ground electrode such that a spark gap is formed therebetween, said heat pipe being thermally non-conducting below a design temperature such that said spark plug firing end runs hot to burn off fouling deposits settling thereon and said heat pipe being thermally conducting above said design temperature to conduct heat rapidly away from said firing end such that the overheating thereof is avoided, said beat pipe varying the operative heat range of said spark plug such that an optimum operating temperature is maintained automatically, said engine being provided with means such that it serves as a heat sink and said heat pipe capillary means are incised directly into the walls of said insulator centerbore, whereby the transfer of heat from said heat pipe to said heat sink is optimized.

2. A spark plug comprising an upper terminal end and a lower firing end adapted to be installed in the cylinder head of an engine, said spark plug including an annular metal shell promimate the firing end thereof with external threads for installing said spark plug for operation in said cylinder head, an elongated electrical insulator having its lower end received in the bore of said shell and including a nose portion spaced radially inwardly from said shell bore, means for sealing said insulator in a gas-tight relationship in said shell, an elongated center conductor assembly received in a centerbore in said insulator, said center conductor assembly comprising an electrical terminal at its upper end, a centerwire, and a center electrode, said center electrode having a firing end protruding from said insulator nose in operative relationship and forming a spark gap with a ground electrode on said shell, means for sealing said center conductor assembly in a gas-tight relationship in said insulator, said electrical terminal being adapted for connecting said spark plug to the ignition system of said engine, a heat pipe in said insulator promimate the firing end thereof with said centerbore of said insulator defining the side walls and transverse elements extending radially from said centerwire to said insulator centerbore defining end walls such that a hermetic heat pipe chamber is formed thereby, means in said centerwire for filling said heat pipe with a vaporizable heat pipe medium, said heat pipe having a vaporization zone promimate said firing end and a condensation zone upwardly distal therefrom with an adiabatic zone therebetween, capillary means extending from said vaporization zone to said condensation zone, said heat pipe being thermally non-conducting below a design temperature range such that said firing end runs hot to burn off fouling deposits, the heating of said firing end above said design temperature vaporizing said vaporizable medium such that its change of state extracts heat from said firing end to prevent its destructive overheating, said vapor moving by its vapor pressure to said condensation zone and condensing to release its heat by a change of state, the condensed medium returning by the capillarity of said capillary means to said vaporization zone such that a circulation that transfers heat from said firing end is established, said circulation ceasing with the cessation of vaporization below said design temperature to render said heat pipe con-conducting such that said heat pipe controls the operative heat range of said spark plug automatically, whereby said capillary means are incised directly into said insulator centerbore defining the side walls of said heat pipe such that the thermal transfer from said condensation zone to the heat sink provided by said engine is optimized.

* * * * *